US006631832B2

(12) United States Patent
Wan et al.

(10) Patent No.: US 6,631,832 B2
(45) **Date of Patent: *Oct. 14, 2003**

(54) SINGLE PIECE, PUSH-PULL DISPENSING CLOSURE AND ASSEMBLY

(75) Inventors: Min Miles Wan, Plainfield, IL (US); Valentin Hierzer, Arlington Heights, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/775,977

(22) Filed: Feb. 2, 2001

(65) Prior Publication Data

US 2001/0017306 A1 Aug. 30, 2001

Related U.S. Application Data

(63) Continuation of application No. 09/455,200, filed on Dec. 6, 1999, now Pat. No. 6,206,230, which is a continuation-in-part of application No. 09/141,658, filed on Aug. 28, 1998, now Pat. No. 6,056,161, which is a continuation of application No. 09/047,812, filed on Mar. 25, 1998, now abandoned.

(51) Int. Cl.[7] ..... B65D 39/08

(52) U.S. Cl. ..... 222/525; 222/522; 220/714; 220/717; 215/387

(58) Field of Search ..... 220/714, 711, 220/716, 717; 215/387; 222/519, 520, 522, 525

(56) References Cited

U.S. PATENT DOCUMENTS

| | | | | |
|---|---|---|---|---|
| 2,345,737 | A | 4/1944 | Fabrice | 222/522 X |
| 2,569,139 | A | 9/1951 | Abelson | 128/252 |
| 2,877,918 | A | 3/1959 | Gardner | 222/522 |
| 2,969,896 | A | 1/1961 | Lerner | 222/520 |
| 3,067,916 | A | 12/1962 | Lerner | 222/519 |
| 3,121,519 | A | 2/1964 | Cherba | 222/519 |
| 3,248,025 | A | 4/1966 | Santore | 222/520 X |
| 3,261,513 | A | 7/1966 | Moran | 222/553 X |
| 3,351,249 | A | 11/1967 | Stull | 222/520 |
| 3,542,258 | A | 11/1970 | Marchant | 222/520 |
| 3,606,105 | A | 9/1971 | Santore | 222/520 |
| 4,295,584 | A | 10/1981 | Borowitz | 222/519 |
| 4,799,598 | A | 1/1989 | McFadyen | 215/260 |
| 4,893,728 | A | 1/1990 | Jennings et al. | 221/306 |
| 4,927,065 | A | 5/1990 | Beck | 222/520 |
| 5,038,967 | A | 8/1991 | Braun | 222/519 |
| 5,079,013 | A | 1/1992 | Belanger | 426/115 |
| 5,104,008 | A | 4/1992 | Crisci | 222/525 X |
| 5,110,017 | A | 5/1992 | Braun | 222/520 |
| 5,111,967 | A | 5/1992 | Schreiber | 222/39 |
| 5,456,374 | A | 10/1995 | Beck | 222/559 X |
| 5,465,876 | A | 11/1995 | Crisci | 222/525 X |
| 5,542,670 | A | 8/1996 | Morano | 220/714 |
| 5,553,731 | A | 9/1996 | Schuyler | 220/719 |
| 5,810,185 | A | 9/1998 | Groesbeck | 222/525 X |
| 5,890,620 | A | 4/1999 | Belcastro | 220/714 |
| 5,890,621 | A | 4/1999 | Bachman et al. | 220/717 |

FOREIGN PATENT DOCUMENTS

| | | |
|---|---|---|
| EP | 0 417 891 | 3/1991 |
| GB | 2 067 979 | 8/1981 |

*Primary Examiner*—Kenneth Bomberg
(74) *Attorney, Agent, or Firm*—Woodcock Washburn LLP

(57) ABSTRACT

A resealable single-piece push-pull dispensing closure is disclosed that includes a circumferential skirt, a top member circumferentially coupled to the skirt, and a sipper spout. The sipper spout extends upwardly from the top member and has a curved sipper surface that truncates to from a substantially flat landing surface. Plural apertures are disposed in the landing surface, and apertures may be disposed at a periphery of the sipper surface. The curvature of the sipper surface has a constant cross section curvature throughout the width of the sipper surface. A user's lip may rest on the sipper surface while drinking directly therefrom, or the top member may have a concave portion in which a user's lip may rest during drinking.

13 Claims, 4 Drawing Sheets

SINGLE PIECE, PUSH-PULL DISPENSING CLOSURE AND ASSEMBLY

This Application is a continuation of Ser. No. 09/455,200 filed Dec. 6, 1999, now U.S. Pat. No. 6,206,230, which is a continuation-in-part of Ser. No. 09/141,658 filed Aug. 28, 1998 now U.S. Pat. 6,056,161, which is a continuation of Ser. No. 09/047,812 filed Mar. 25, 1998, abandoned.

BACKGROUND OF THE INVENTION

This invention relates to dispensing closures for containers and the combination thereof, and more particularly to single piece, push-pull dispensing closures for containers and the combination thereof.

Push-pull dispensers have been employed with a wide variety of products, including water, juices, condiments, and detergents. Push-pull dispensers enable the closure to be opened and closed without removing or separating any portion of the closure from the container, as well as providing other advantages. Thus, push-pull dispensers have gained widespread commercial acceptance.

Conventional push-pull dispensers are constructed from two interlocking pieces, including a bottom piece coupled to the container and a top piece slidably engaging the bottom piece. The bottom piece typically includes an circular member having a center hole, an upwardly depending skirt around the periphery of the hole, and a downwardly depending skirt connected to the outer periphery of the circular portion. The downwardly depending skirt includes threads that engage matching threads on the container. An elevated cylinder is disposed within the upwardly depending skirt that is supported by connectors.

The top piece includes an annular skirt having an upper and lower portion. The top piece has an orifice sized to engage the elevated cylindrical portion of the bottom piece to form a cap over the donut-shaped orifice of the bottom piece. The lower portion is sized is sized to fit over and slidably engage the upwardly depending skirt of the bottom piece whereby it can be raised and lowered. In its lower, closed position, the elevated cylinder plugs the orifice of the top piece to prevent discharging of the liquid contents within the container. In the upper, open position, the elevated cylinder disengages the orifice on the top piece to permit flow therethrough.

The two piece push-pull dispenser described above has disadvantages compared with single-piece screw-type detachable closures, including greater manufacturing costs associated with the two pieces and a smaller orifice and dispensing area. Further, because the top piece generally must be smaller than the outside diameter of the closure, the orifice is restricted, thereby causing a high velocity stream of liquid during dispensing which is undesirable in many applications, such as direct drinking from the closure.

U.S. Pat. No. 5,038,967 discloses a single-piece screw-type dispenser that employs a sealing ring having an inclined or frusto-conical outer sealing surface. The sealing surface engages an inner rim edge of the container neck. To provide a seal, the container neck contacts the rim edge only circumferentially along a thin portion of the sealing ring. To effectively provide the seal, the sealing ring must be urged tightly against the rim edge because only lightly contacting the frusto-conical sealing surface against the inner rim edge of the container would likely not provide adequate sealing because of manufacturing tolerances, slight burrs, and similar manufacturing and assembly irregularities. Thus, without inordinately tight manufacturing tolerances, the configuration of the '967 patent is not suitable for a push-pull closure because the treaded connection may be necessary to generate sufficient force to deflect or deform the sealing surface to provide continuous and repeatable sealing contact with the container neck.

U.S. Pat. No. 4,927,065 discloses an adjustable closure metering cap that may be configured either with a push-pull or a screw type action. The closure cap has a central metering post that includes slots, grooves, ramps, steps, or combinations thereof to provide various metered dispensing openings. Because the dispensing portion of the metering post is smaller than the container neck, and because the metered openings further constrict the dispensing flow rate, the closures disclosed in the '065 patent are not suitable where high flow rate is desirable. Further, the disclosure is primarily directed to two-piece closures which have the drawbacks described above.

U.S. Pat. No. 3,351,249 discloses a screw cap closure having an annular sealing portion that is insertable within the container neck. Because the apertures are disposed within the sealing portion, the area through which the product may flow is restricted.

It is a goal of the present invention to provide a push-pull dispensing closure from which a user may comfortably drink directly from or which may be used to dispense liquid by squeezing the closure at a desirably flow rate.

SUMMARY OF THE PRESENT INVENTION

A container assembly for liquid contents is provided that comprises a container including a container body and a neck extending upwardly therefrom and a re-sealable push-pull closure. The closure is a single piece that is slidable on a smooth, continuous container neck. The closure is moveable between a closed position that substantially seals the container and a dispensing position that enables dispensing of the liquid contents through the closure. The closure consists only of a single component that comprises a substantially circular top member, a circumferential skirt, a sipper spout, and a plug.

The skirt extends downwardly from the top member and is integrally formed therewith. The skirt has a circumferential skirt bead extending inwardly on an inner surface thereof that slidably engages the container neck. The sipper spout extends upwardly from the top member and includes a concave sipper surface capable of receiving a user's lip and at least one dispensing aperture formed in the sipper spout for dispensing the liquid.

The plug depends downwardly from the top member and engages the container neck to form a seal therewith while the closure is in the closed position. The plug is spaced apart from the container neck while the closure is in the dispensing position to enable the liquid contents to flow therebetween. The plug may have a sealing bead that engages an inner sidewall of the container neck to form the seal. Each one of the neck outer surface and the skirt inner surface may have a bead that rides on the opposing surface to form a seal therewith. The beads limit may the longitudinal travel of the closure.

According to an aspect of the present invention, the spout has a sipper surface that is curved to comfortably receive a user's lip during drinking directly therefrom. The sipper surface may have a smooth, longitudinal cross sectional profile that is constant regardless of where the cross section is taken along longitudinal sections that are mutually parallel. Further, the closure may have a concave portion formed in the top member that may receive a user's lip alternatively to or in combination with the sipper surface. According to another aspect of the present invention, the spout has a substantially flat, horizontal landing surface at the uppermost portion of the spout. Apertures may be formed in the landing surface and also in the sipper surface at the periphery of the top member.

DETAILED DESCRIPTION OF PREFERRED EMBODIMENTS

Figure 1:
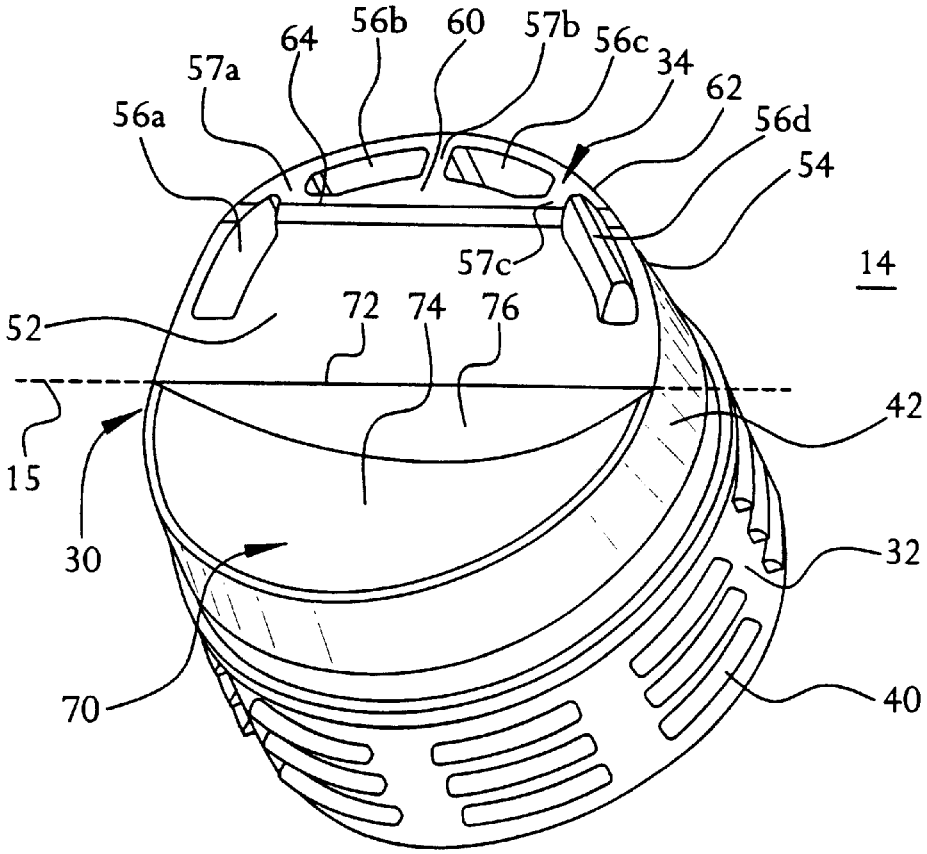
FIG. 1 is a perspective view of a closure according to a first embodiment of the present invention.
Figure 8:
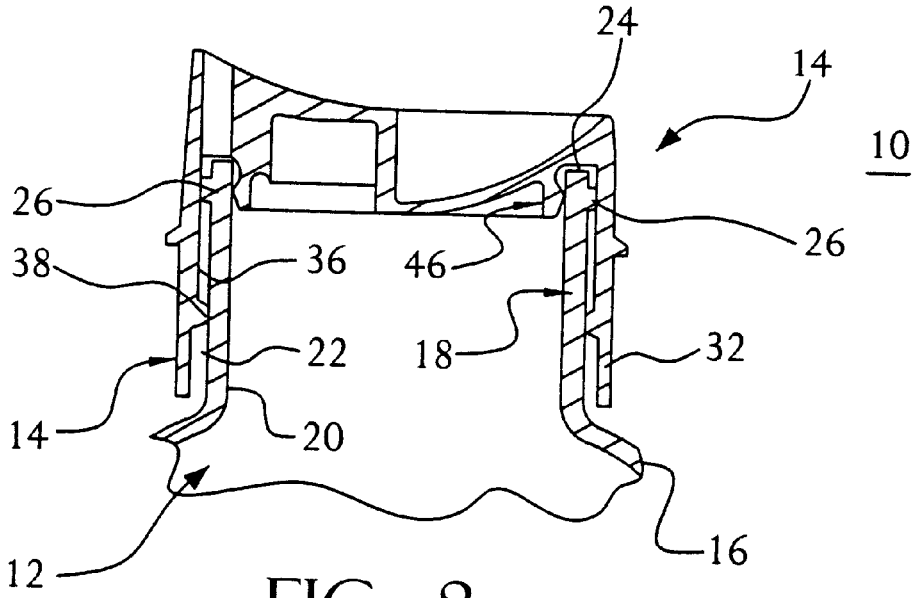
FIG. 8 is a sectional view of the closure according to the first embodiment shown in combination with the container in a fully closed position according to an aspect of the present invention.
Figure 9:
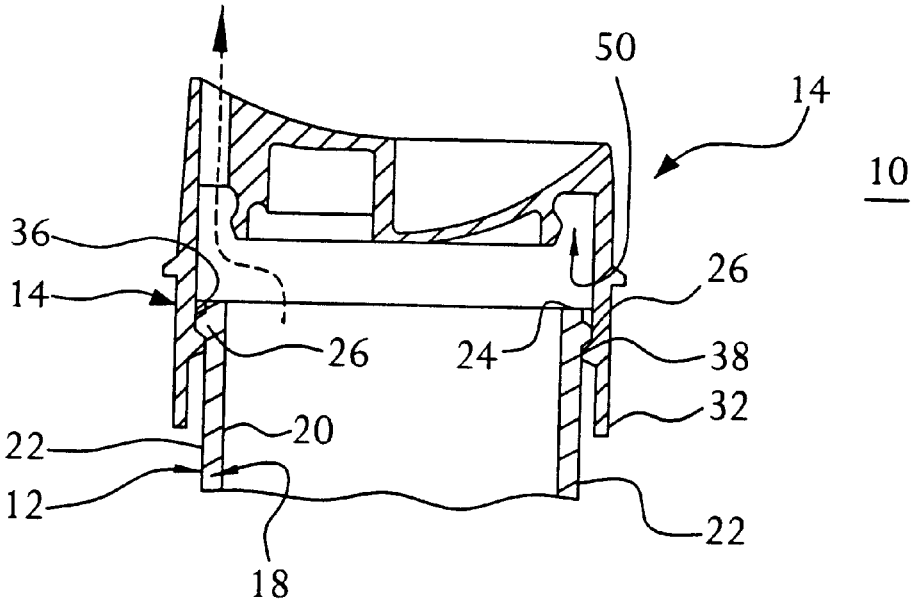
FIG. 9 is a sectional view of the closure according to the first embodiment in combination with the container in a fully open position according to an aspect of the present invention.

Referring to the Figures to describe embodiments according to the preset invention, and particularly to FIGS. 8 and 9, a container assembly 10 includes a container 12 and a closure 14, which is shown in FIG. 1. Container 12 broadly encompasses any type of conventional container for holding liquids or pastes, and particularly containers for holding liquid beverages. Container 12 includes a container body 16 that forms a chamber therein for holding the liquid beverage contents and a neck 18 at the top of body 16 that defines a container aperture.

Neck 18 includes a substantially cylindrical inner sidewall 20, a substantially cylindrical outer sidewall 22, and a rim 24 therebetween that defines the uppermost portion of the container 12. Preferably, a circumferential neck bead 26 extends radially outwardly from the outer sidewall 22. Neck 18 preferably has a cylindrical shape with a smooth, continuous finish without features extending outwardly therefrom and without features extending inwardly thereto other than bead 26 such that sidewall 22 forms only a pure cylinder without depressions or protrusion over the portion that a bead on closure 14 slides (described below). Thus, the smooth, continuous surface of neck 18 provides a smooth sealing surface that closure 14 may slidably and sealably engage.

Referring particularly to FIGS. 1 through 4, closure 14 includes a top member 30, a skirt 32, and a sipper spout 34. Top member 30 preferably has an overall shape that is circular. Skirt 32 is substantially tubular and circumferentially downwardly depends from the periphery of top member 30. Skirt 32 has an inner surface 36 that is substantially cylindrical to match the shape of container neck 18. A circumferential skirt bead 38 is disposed on inner surface 36. Skirt 32 has an outer surface on which plural ribs 40 are disposed to enhance gripping of the closure 14.

A plug is disposed on the underside of closure top member 30 that includes a plug body 46. The substantially cylindrical plug body 46 extends downwardly from top member 30. A circumferential plug bead 48 is disposed on an outer surface of plug body 46. Plug body 46 is spaced apart from skirt inner surface 36 to form an annular cavity 50 therebetween. An underside of top member 30 forms an upper boundary of cavity 50.

Sipper spout 34 is a protruding extension of the top member that provides surfaces on which a user may place his or her lips for enhancing the ability to drink from the closure. Further, the sipper spout 34 may enhance the ability to discharge liquid from the container through the closure either by pouring or squirting. Spout 34 preferably extends upwardly from a peripheral edge of skirt 32.

Specifically, referring to FIGS. 1 through 4, a periphery of spout 34 is preferably defined by a substantially circular curved spout sidewall 54 that extends upwardly from skirt 32 above top member 30. Spout sidewall 54 ends at a curved uppermost edge 62. Preferably spout sidewall 54 is arcuate and smoothly yields to the skirt 32 at its bottom portion. Spout sidewall 54 and a portion of the sidewall of skirt 32 preferably each have a taper that extends inwardly and upwardly to define tapered portion 42. Preferably, the portion of skirt 32 below tapered portion 42 has an outer surface that is substantially cylindrical or has a shape that substantially matches the shape of the container neck.

Spout 34 also includes a sipper surface 52 that is curved to provide a comfortable place on which a user's lip may rest during drinking from the closure 14. Preferably, sipper surface 52 is substantially concave as viewed from outside of the closure and best shown in FIGS. 1 and 4 to provide an ergonomic shape, which was tested by trial and error. Sipper surface 52 gradually curves upwardly from top member 30 (above the edge of skirt 32) toward spout sidewall 54. Preferably, sipper surface 52 has an inner boundary that is defined by a chord of the skirt. Even more preferably, the chord that defines the inner boundary of the sipper surface 52 is substantially co-linear with a line 15 of the closure, which preferably is co-incident with a center of skirt 32. Preferably, the sipper spout 34 (including the sipper surface 52 and the landing surface) covers half or less than half of the total top surface area of the closure for a 28 mm container finish (and similar sizes) so that the sipper spout 34 may easily and comfortably fit a user's mouth. The sipper spout may preferably cover greater than half of the tope surface area for container necks significantly smaller than the 28 mm finish. The present invention also encompasses a boundary of sipper surface 52 that is curved (not shown) rather than straight as shown in the Figures.

Figure 2:
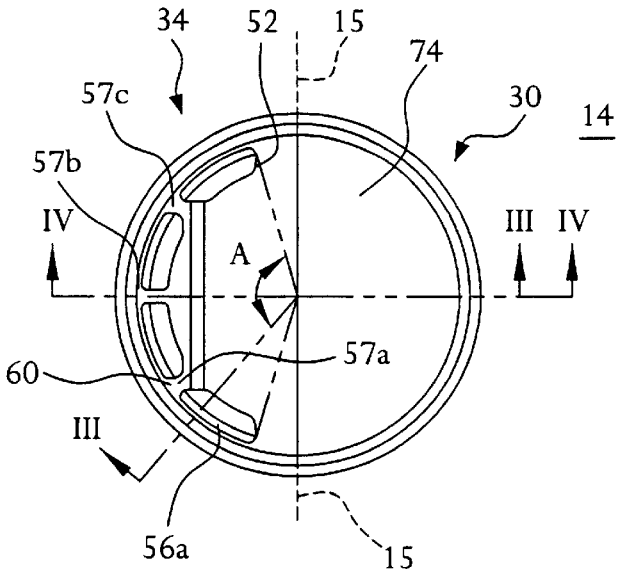
FIG. 2 is a top view of the closure of FIG. 1.
Figure 4:
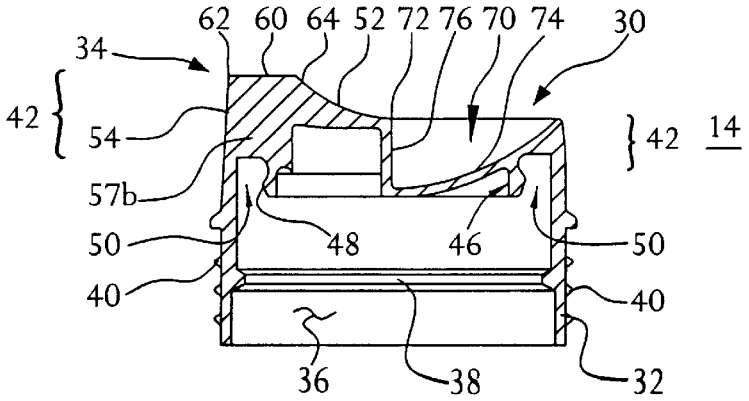
FIG. 4 is a sectional view of the closure taken through lines IV—IV of FIG. 2.

The curve that defines the cross section of sipper surface 52 preferably is uniform with respect to the longitudinal cross section as shown in FIG. 4. Specifically, the curve that defines sipper surface 52 is constant, preferably as shown in FIG. 4, for longitudinal cross sections taken through closure 14 parallel to line IV—IV, which is shown in FIG. 2, anywhere along line 15, although the upper ends of the curve may be truncated near the outer boundary of the skirt 32. The curve of sipper surface 52, in cross section, may be formed by a portion of a circle, an ellipse, or other shape that provides a comfortable surface for receiving a user's lip.

Sipper surface 52 curves upward toward uppermost edge 62 of spout sidewall 54. A landing surface 60 is formed in at least a portion of uppermost edge 62. Preferably landing surface 60 is disposed at the outer, uppermost periphery of sipper surface 52 such that an outer boundary of landing surface 60 yields to spout sidewall 54. Thus, landing surface 60 and spout sidewall 54 are separated by and share uppermost edge 62. Preferably, landing surface 60 is substantially flat and horizontal. For spout sidewalls that have a circular transverse cross section, uppermost edge 62 preferably is circular and substantially horizontal in the region of landing surface 60.

An inner boundary 64 of the landing surface 60 preferably is formed by a chord 64 that subtends a portion of spout sidewall edge 62. Chordal boundary 64 of landing surface 60, like the preferred configuration of the landing surface 60, preferably is flat. Landing inner boundary 64 separates and is shared by landing surface 60 and the concave portion of sipper surface 52. A substantially flat landing surface provides a comfortable surface on which or under which a user's tongue may rest during drinking from closure 14, as described more fully below. A sharp edge has been uncomfortable for some users.

Further, providing a flat landing enhances injection molding characteristics by, for example, eliminating sharp edges which are more difficult to form by injection molding than a flat surface. The flat landing surface also provides a convenient surface for gating the mold. The term "chord" as used herein refers to a straight line, although it will be clear to persons familiar with closure or plastic technology that a curved line can be substituted therefor. Thus, for example, the present invention encompasses a landing surface having a curved inner boundary.

Closure 14 must have at least one dispensing aperture formed therein for enabling flow communication of the liquid contents therethrough. The dispensing aperture preferably is disposed in the upper parts of sipper spout 34. Because, inter alia, of structural and molding considerations, plural apertures are preferred compared to a single larger aperture. The plural apertures may be mutually separated by intervening structure such as bridges.

Preferably, a pair of apertures 56*b* and 56*c* are formed in landing surface 60, and mutually separated by a bridge 57*b*. Apertures 56*b* and 56*c* preferably have an elongate curved, slotted shape and are arranged end to end with bridge 57*b* therebetween.

Another pair of apertures 56*a* and 56*d* may be formed in concave sipper surface 52 adjoining landing surface 60 and near the periphery of the upwardly projecting portion of uppermost edge 62. Apertures 56*b* and 56*c* are disposed between apertures 56*a* and 56*c* such that aperture 56*a* is proximate a longitudinal end of aperture 56*b*, and aperture 56*d* is disposed proximate a longitudinal end of aperture 56*c*. Preferably, each of end apertures 56*a* and 56*d* have a curved slotted shape that defines a radius equal to that of center apertures 56*b* and 56*c*. Preferably, end apertures 56*a* and 56*d* have a small portion or extension that projects into or is formed in landing surface 60, as best shown in FIG. 1.

Figure 5:
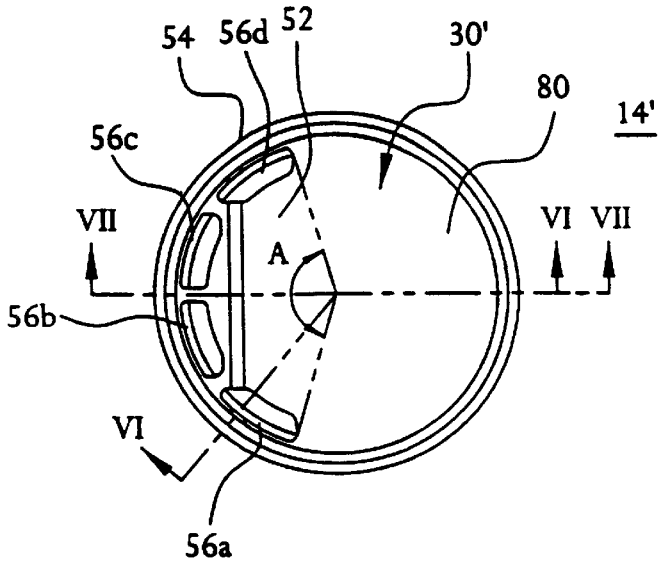
FIG. 5 is a top view of a second embodiment of the closure according to the present invention.

Apertures 56*a*, 56*b*, 56*c*, and 56*d* are arranged in an arcuate configuration, indicated in FIGS. 2 and 5 by angle A, proximate the peripheral edge of the closure 14. Specifically, according to an aspect of the present invention, the apertures are disposed on the outboard side of the plug body 46 within sidewall 54 in a configuration that preferably maximizes the aperture cross-sectional area therebetween. Thus, as will be understood by persons familiar with closures and polymer design, the size of the bridges between the apertures may be minimized to maximize the open area.

As shown in FIGS. 2 and 5, angle A is less than 180 degrees. Preferably, the apertures 56*a* through 56*d* and illustrated by angle A should not extends past the centerline on the closure (that is, line 15 in the embodiment of FIG. 2) to diminish spilling during drinking or other types of dispensing. Tests of closures having apertures disposed in an arc of greater than 180 degrees (not shown) have produced some spilling while drinking or other dispensing. Therefore, the apertures preferably span 180 degrees or less over the upper portion of the closure. For configurations in which maximum flow is desirable, the apertures span 180 degrees.

Figure 3:
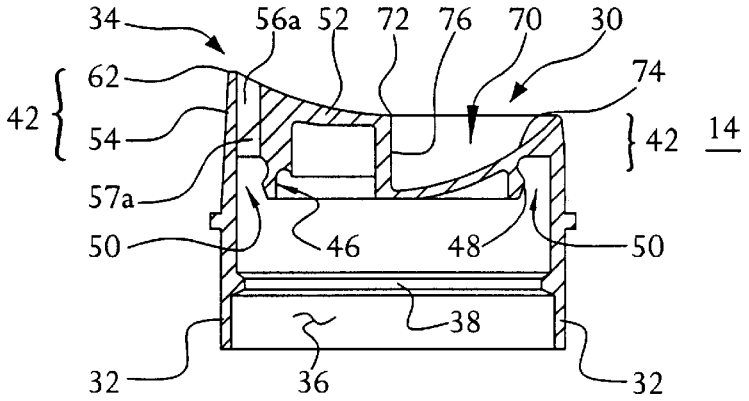
FIG. 3 is a sectional view of the closure taken through lines III—III of FIG. 2.

Referring particularly to FIGS. 1, 3, and 4, top member 30 preferably has a concave surface 74 formed therein. Concave surface 74 is an inward depression or cavity in top member 30 on which or in which a user's lip may rest during drinking from closure 14. Thus, a user may position his or her upper lip either on sipper surface 52, concave surface 74, or a combination of surfaces 52 and 74 to drink from sipper spout 34.

Concave surface 74 extends inwardly and downwardly preferably from the periphery of skirt 32 such that concave surface 74 has a curved outer boundary, which enhances user comfort while the user's lip is engaged with surface 74. Concave surface 74 may extend to line 15, and may form a portion of a sphere, or have an elliptical or other curved shape in longitudinal cross section. An end wall 76 extends from an end of surface 74 from an end of sipper surface 52 at line 15. Preferably, end wall 76 is substantially vertical, although the present invention encompasses an inclined or curved end wall (not shown), as well as a concave surface 74 that gradually and smoothly yields to sipper surface 52 (not shown).

Thus, closure 14 provides a spout assembly that a user may comfortably engage with his or her lips because of the geometry of the spout and top member, and provides adequate aperture cross sectional area and configuration to obtain adequate flow therethrough. Further, the single piece, push-pull nature of the closure enhances ease of use. The lack of features on the skirt sidewall and neck sidewall enable straight longitudinal actuation without the need for concern of alignment or binding.

Figure 6:
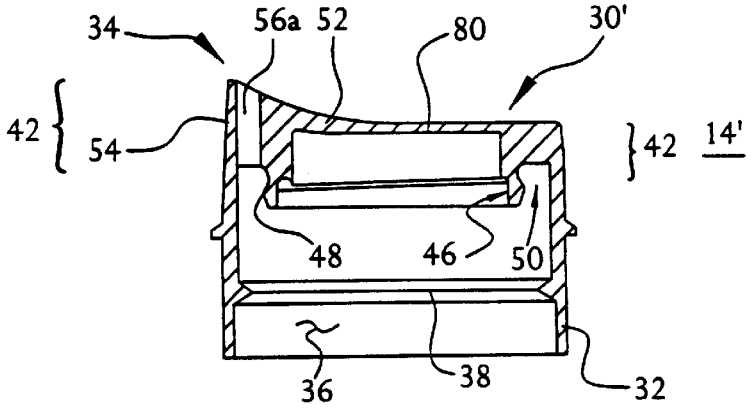
FIG. 6 is a sectional view of the closure taken through lines VI—VI of FIG. 5.
Figure 7:
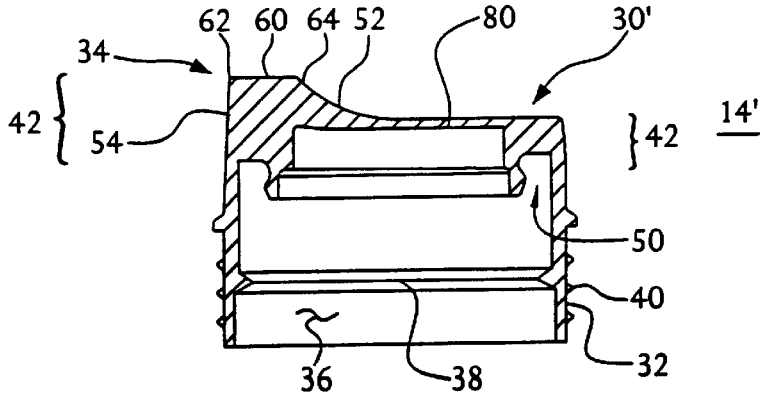
FIG. 7 is a sectional view of the closure taken through lines VII—VII of FIG. 5.

Referring to FIGS. 5, 6, and 7 to illustrate a second embodiment of the present invention, a closure 14' has a skirt 32, a sipper spout 34, and a plug 46 similar to those described with respect to the closure 14 of the first embodiment. The second embodiment closure 14' has a top member 30'. Sipper spout 34 extends upwardly from line 15 as described with respect to the first embodiment. On the opposing side of line 15 from the spout 34, top member 30' extends from line 15 to the periphery of top member 30' to join an upper sidewall of skirt 32. Between line 15 and skirt 32 on the side of line 15 opposite spout 34, top member 30' is substantially flat.

FIGS. 8 and 9 illustrate the operation of the closure 14, although the Figures and the corresponding description also describe the operation of the closure 14' according to the second embodiment. Referring particularly to FIG. 8, closure 14 has a closed position in which the closure is in its downward-most position relative to container 12. In the fully closed position of FIG. 8, the upper portion of closure neck 18 extends in to cavity 50 between the plug and the inner wall 36 of the skirt such that the plug extends within neck 18 of closure. Specifically, plug body 46 extends through the opening in neck 18, and plug bead 48 circumferentially contacts neck inner sidewall 20 to form a seal therewith.

Neck rim 24 may contact the underside of tip member 30 within cavity 50 to limit the movement of closure 14 relative to container 12. Skirt bead 38 extends inwardly from skirt 32, and circumferentially contacts neck outer sidewall 22. Neck bead 26 extends from neck outer sidewall 22, and circumferentially contacts skirt inner surface 32.

Referring to FIG. 9 to illustrate the open position of closure 14, a user may enable assess or dispensing of the liquid contents within container 12 by grasping closure 14, for example by gripping ribs 40, and urging closure 14 longitudinally apart from container 12. As closure 14 is moved from the closed position of FIG. 8 toward the open position of FIG. 9, rim 24 is disengaged from the upper surface of cavity 50 and container neck 18 is disengaged from plug body 46 as neck bead 26 slides over skirt inner surface 36 and skirt bead 38 slides over neck outer surface 22. Upon the disengagement of neck 18 from plug bead 26, a passage is formed that enables communication from the interior of the container, between the upper portion of neck 18 and the plug body 46, and through the apertures 56*a,* 56*b,* 56*c,* and 56*d.* The passage is shown by the broken line in FIG. 9. Closure 14 may be moved from the open position to the closed position, and thus is re-sealable.

The liquid contents may be dispensed by tilting the container 12 to an inclined position that enables the liquid contents to flow through the closure apertures. The container also may be provided with flexible sidewalls that a user may deform by squeezing to urge the contents through the apertures. Squeezing the container sidewalls may enhance the dispensing flow rate for beverages or more viscous liquids, such as detergents.

Although the configuration of closures 14 and 14' are preferred and provide particular advantages, the present invention encompasses other configurations that will be apparent to persons familiar with closure technology and plastic injection molding technology. For example, the present invention encompasses various shapes and configurations of dispensing apertures including having apertures disposed only on landing surface 60, providing landing surface 60 that is neither flat nor horizontal, providing landing surface 60 such that it smoothly yields to concave sipper surface 52, providing sipper surface 52 as an evenly sloped or inclined surface or having convex portions, and like configurations within the full scope of the claims.

Further, the present invention is described with respect to a substantially circular overall shape. The present invention, however, is not limited thereto. Rather, the present invention encompasses a closure having any shape that may be engaged to a correspondingly shaped container neck, including for example an oblong or elliptical shaped container on which a respectively oblong or elliptical shaped closure may be mounted.

We claim:

1. A container assembly for liquid contents, comprising:

a container including a container body and a neck extending upwardly therefrom; and a re-sealable push-pull closure moveable between a closed position that substantially seals the container and a dispensing position that enables dispensing of the liquid contents through the closure, the closure consisting of a single component that comprises:

a circumferential, tubular skirt including a circumferential skirt bead extending inwardly on an inner surface thereof that slidably engages the container neck;

a top member including a peripheral lower portion and a sipper spout, the lower portion defining an upper edge of a portion of the skirt, the sipper spout extending upwardly from the lower portion and including dispensing apertures separated by bridges, the apertures and bridges forming a segment of a circular shape, an uppermost rim of at least one of the apertures is entirely disposed at an elevation above the lower portion of the top member; and a plug depending downwardly from the top member, the plug engaging the container neck to form a seal therewith while the closure is in the closed position and spaced apart from the container neck while the closure is in the dispensing position to enable the liquid contents to flow therebetween.

2. The container assembly of claim 1 wherein the closure is capable of translating longitudinally without rotation between the closed position and the dispensing position, the closed position corresponding to the closure being retracted and the dispensing position corresponding to the closure being extended relative to the container.

3. The container assembly of claim 1 wherein the sipper surface includes a substantially horizontal surface at and uppermost surface thereof, and at least one of the apertures is formed at least partly in the substantially horizontal surface.

4. The container assembly of claim 3 wherein the apertures are elongate and curved.

5. The container assembly of claim 3 wherein the apertures are a first apertures, a second aperture, a third aperture, and a fourth aperture formed in the sipper spout, the first, second, third, and fourth apertures are elongate and arranged end-to-end to define said bridges therebetween.

6. The container assembly of claim 3 wherein the sipper spout includes an intermediate surface disposed between and coupling together the lower portion and the substantially horizontal surface.

7. The container assembly of claim 6 wherein the lower portion includes a downwardly concave portion formed therein.

8. The container assembly of claim 6 wherein the lower portion of the top member is a substantially planar horizontal surface.

9. The container assembly of claim 6 wherein the sipper spout includes an outer wall opposite the intermediate surface, said circular shape formed by the apertures and bridges is disposed proximate said outer wall.

10. The container assembly of claim 9 wherein the apertures are part of a channel that extends through the top member to enable fluid to be dispensed therethrough while the closure is in its dispensing position, the channel being formed in part by the sipper spout outer wall, a rim of the container neck being disposed in the channel while the container is in its closed position.

11. The container of claim 10 wherein a seal is formed is formed by contact between the plug and the container neck and the container rim does not form the seal in the channel.

12. The container assembly of claim 1 wherein the sipper spout extends substantially vertically upward and the first dispensing aperture is substantially vertical while the container assembly is upright.

13. The container assembly of claim 1 wherein said circular shape formed by the apertures and bridges is concentric with the skirt.

* * * * *